US007093519B1

(12) United States Patent
Huang

(10) Patent No.: US 7,093,519 B1
(45) Date of Patent: Aug. 22, 2006

(54) COMBINATION WRENCH

(76) Inventor: Wen-Kuo Huang, No. 18, Kai-an 5th St.., Annan District, Tainan City 709 (TW)

( * ) Notice: Subject to any disclaimer, the term of this patent is extended or adjusted under 35 U.S.C. 154(b) by 0 days.

(21) Appl. No.: 11/380,197

(22) Filed: Apr. 25, 2006

(51) Int. Cl.
*B25B 13/46* (2006.01)

(52) U.S. Cl. ..... 81/60; 81/177.1; 81/125.1; 81/124.7

(58) Field of Classification Search ..... 81/60, 81/124.7, 125.1, 177.1, 177.5, 177.7, 180
See application file for complete search history.

(56) References Cited

U.S. PATENT DOCUMENTS 5,797,300 A * 8/1998 Fairbanks ..... 81/60
D465,976 S * 11/2002 Wang ..... D8/17
6,868,758 B1 * 3/2005 Chen ..... 81/60
6,898,998 B1 * 5/2005 Shyu ..... 81/63.1
6,938,521 B1 * 9/2005 Skeens ..... 81/60
2003/0188607 A1 * 10/2003 Hsien ..... 81/177.7

* cited by examiner

*Primary Examiner*—Lee D. Wilson
*Assistant Examiner*—Anthony Ojini
(74) *Attorney, Agent, or Firm*—Banger Shia

(57) ABSTRACT

This invention discloses a three-in-one combination wrench. A preferred embodiment features an easily assembled ratchet wrench in the middle of the wrench body, suitable for operation in confined spaces. The combination wrench terminates at one end in a pair of opening jaws for engaging fasteners of various sizes that fit into the jaws; and at the other, in an adjustable mortise-tenon pivotal wrench for approaching fasteners from an optimal angle to maximize torque with least effort. Furthermore, a substantially symmetrical streamlined dual-handle is ergonomically configured for a comfortable holding gesture.

8 Claims, 9 Drawing Sheets

COMBINATION WRENCH

BACKGROUND OF THE INVENTION

1. Field of the Invention

This invention relates to a hand-operated wrench, and more particularly to a compact three-in-one combination wrench with great accessibility to fasteners and workpieces. A preferred embodiment in accordance with this invention includes a ratchet wrench in the center of the wrench body, an open-end V-shaped socket wrench at one end of the wrench body, and an adjustable mortise-tenon pivotal wrench at the other end. The two handle portions in between the above-mentioned three parts are ergonomically adapted for a friendly human-machine interface.

2. Description of Prior Art

It is the goal of this invention to provide some feasible solutions for problems encountered in the prior art, as stated below.

FIG. 7 depicts a T-handle wrench with a sleeve or a socket configured at the end of the bar, which is perpendicular to the handle. Wrenches of this kind are only applicable to certain sizes of fasteners that fit into the one-size sleeve, and hence have limited applications.

FIG. 8 shows an improvement on T-type wrenches, which is configured to have a ratchet wrench at the head of the wrench body, and a drive shaft for engaging sleeves of various sizes. This kind of wrenches, however, requires a working space of at least the diameter of the length of the wrench body for a 360-degree rotation about fasteners, not desirable for operation in cramp spaces.

In a basic socket wrench embodiment, the main body is made cylindrical in shape, as shown by handle 32' of a conventional wrench (3') in FIG. 9, which is also configured with drive shaft 31' to accommodate a wide range of workpieces. In U.S. Pat. No. 6,792,833 to Macor a double-ended wrench having a flat elongated-shaped handle is produced to overcome the inconvenience of gripping a bulky cylindrical handle. In the present invention, a symmetrical streamlined dual-handle is designed to relieve muscular stiffness in holding substantially straight handles.

U.S. Pat. No. 6,862,956 to Chen, as well as U.S. Pat. No. 6,807,882 to Hu disclose ratchet wrenches with a simplified structure, both of which still have the disadvantage of complexity in assembly, demanding higher precision in machining.

SUMMARY OF THE INVENTION

It is therefore the purpose of this invention to provide a cost-effective compact wrench, which operates flexibly in cramp spaces on fasteners of various sizes with least wrist effort. This invention features a wrench with three parts:

(1) a simply structured ratchet wrench in the center of the wrench body, (2) a socket wrench with opening jaws on one end of the wrench body, and (3) an adjustable mortise-tenon pivotal wrench on the other end.

According to this invention, the opening jaws in the socket wrench are spaced to define a substantially V-shaped opening for fasteners clamped within, which are of varied sizes smaller than the distance between the inner sides of the tips of jaws. The inner side of a jaw attaching fasteners is further toothed for a firm clamping.

By having a ratchet wrench positioned in the middle or center of a wrench as apposed to an end, space required for a rotation around fasteners is reduced by about half of the length of the whole wrench body. A circular chamber is thus defined in the center of the combination wrench to receive a ratchet driving body. The inside wall of the circular receiving chamber has a plurality of ratchet teeth for making a thread joint with a ratchet driving body.

A ratchet driving body is manufactured integrally with a drive shaft at the bottom, a lower annular groove, an upper annular groove, an exterior toothed wall in between the lower and the upper annular groove, and a direction-switch on the top. The toothed exterior wall of the ratchet driving body meshes with the inside wall of the circular receiving chamber for a thread joint. The assembly of a ratchet wrench in this invention requires only a snap coil for locking the ratchet driving body in its receiving chamber, significantly cost effective and time-saving.

The third part of this combination wrench is a mortise-tenon pivotal wrench. The advantage of a mortise-tenon pivotal wrench is that the operational angle formed by the axis of the tenon and that of the whole wrench body is adjustable to best suit the position of a fastener. By adjusting the position of the tenon, the mortise-tenon wrench provides great flexibility in approaching fasteners from an angle which maximizes the torque, and reducing chances of fatigue or hand injury from long-term usage.

To further facilitate a comfortable human-machine interface in hand-operated tools, the handle portions concaves inwardly in a streamlined way from the two ends of the wrench body to the center. During operation of the wrench, the thumb therefore fits nicely into the streamlined concaved portion to produce a high torque with least wrist effort.

The advantages of this invention over the known art will become more apparent to those of ordinary skilled in the art upon reading the following descriptions in conjunction with the accompanying drawings.

DETAILED DESCRIPTION OF THE DRAWINGS

Figure 7:
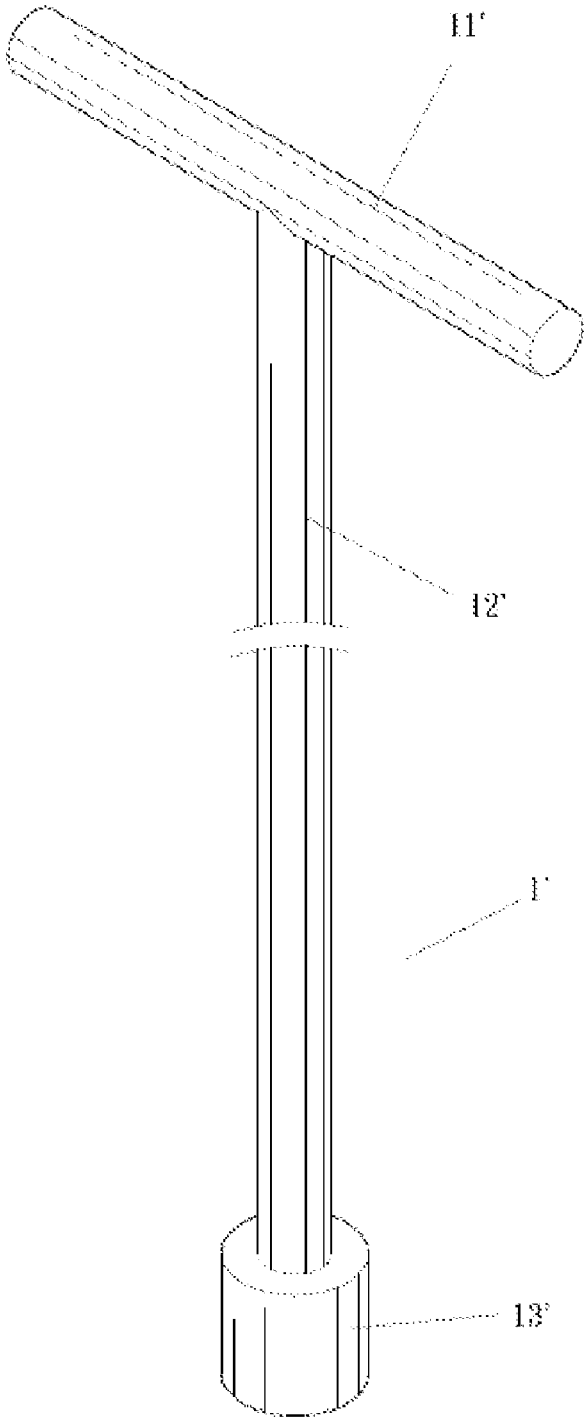
F I G . 7(PRIOR ART)
FIG. 7 shows a conventional T-handle wrench configured with a sleeve.
Figure 8:
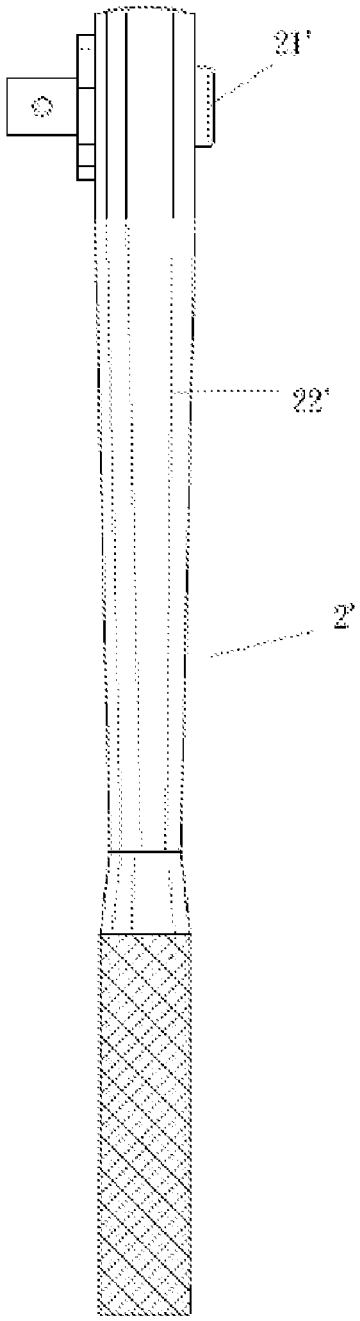
F I G . 8(PRIOR ART)
FIG. 8 shows a conventional socket wrench configured with a drive shaft.
Figure 9:
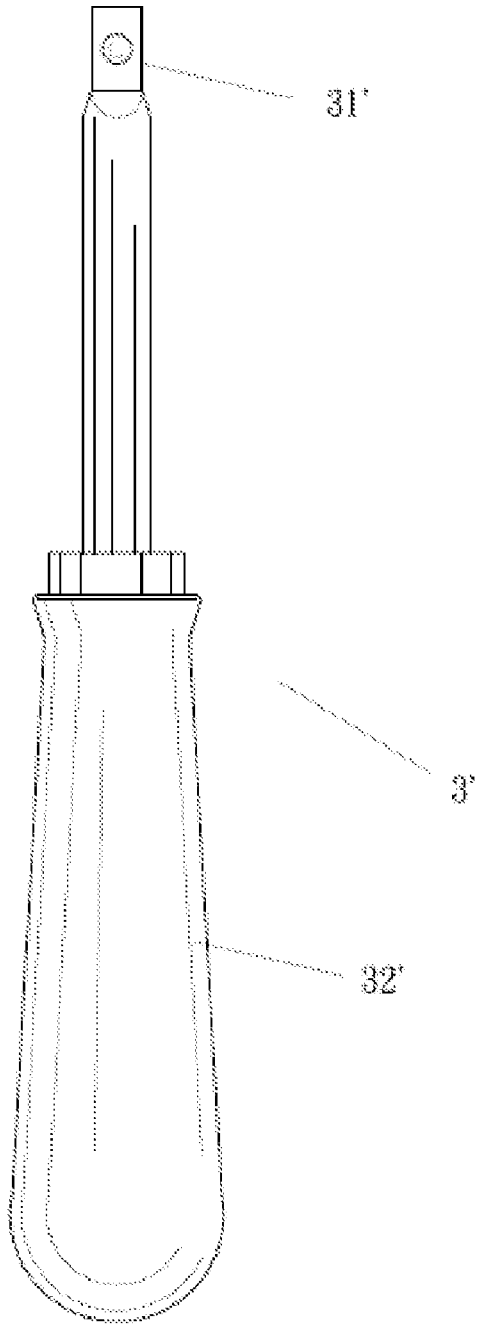
F I G . 9(PRIOR ART)
FIG. 9 shows a conventional socket wrench with a cylindrical handle.

FIG. 7–FIG. 9 review some conventional prior arts. FIG. 7 shows a T-handle wrench (1') with straight cylindrical handle 11' perpendicular to vertical bar 12', at the end of which is formed with fixed-sized sleeve 13' for engaging fasteners of a limited size rage. FIG. 8 shows an improved ratchet wrench (2') with handle 22', where ratchet driving body 21' is installed at the head of the wrench. A disadvantage of this kind of wrenches is that the handle may be too long to fit into a confined space for a 360-degree rotation around fasteners. FIG. 9 also shows a conventional wrench (3') with drive shaft 31' at one end, and a bulky cylindrical handle 32' at the other end.

Figures 1, 1A:
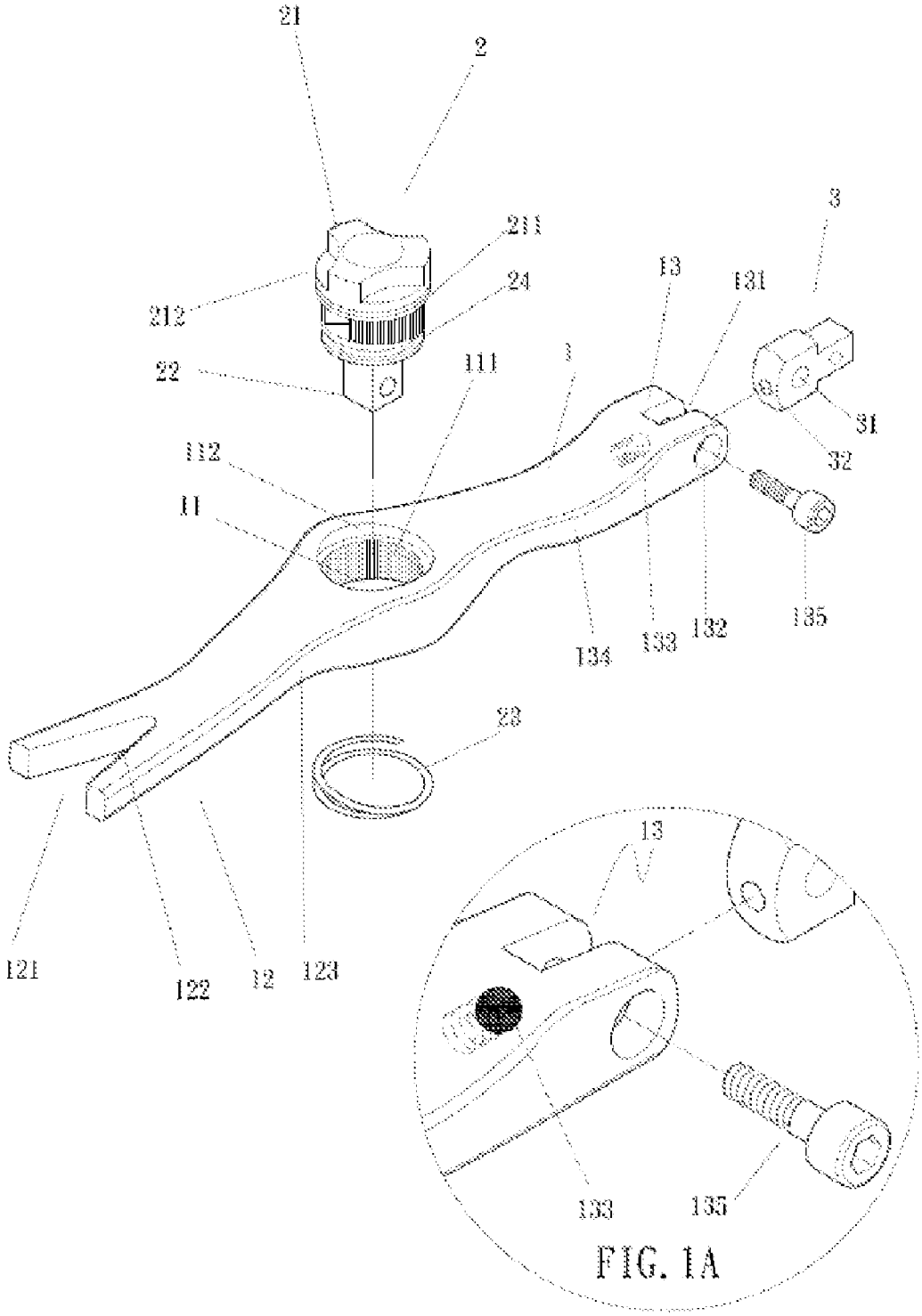
FIG. 1 is an exploded perspective view of a combination wrench in accordance with a preferred embodiment this invention.
FIG. 1A is a partially enlarged view of the adjustable mortise-tenon pivotal wrench in FIG. 1, focusing on the interface between the mortise and the tenon.
Figure 2:
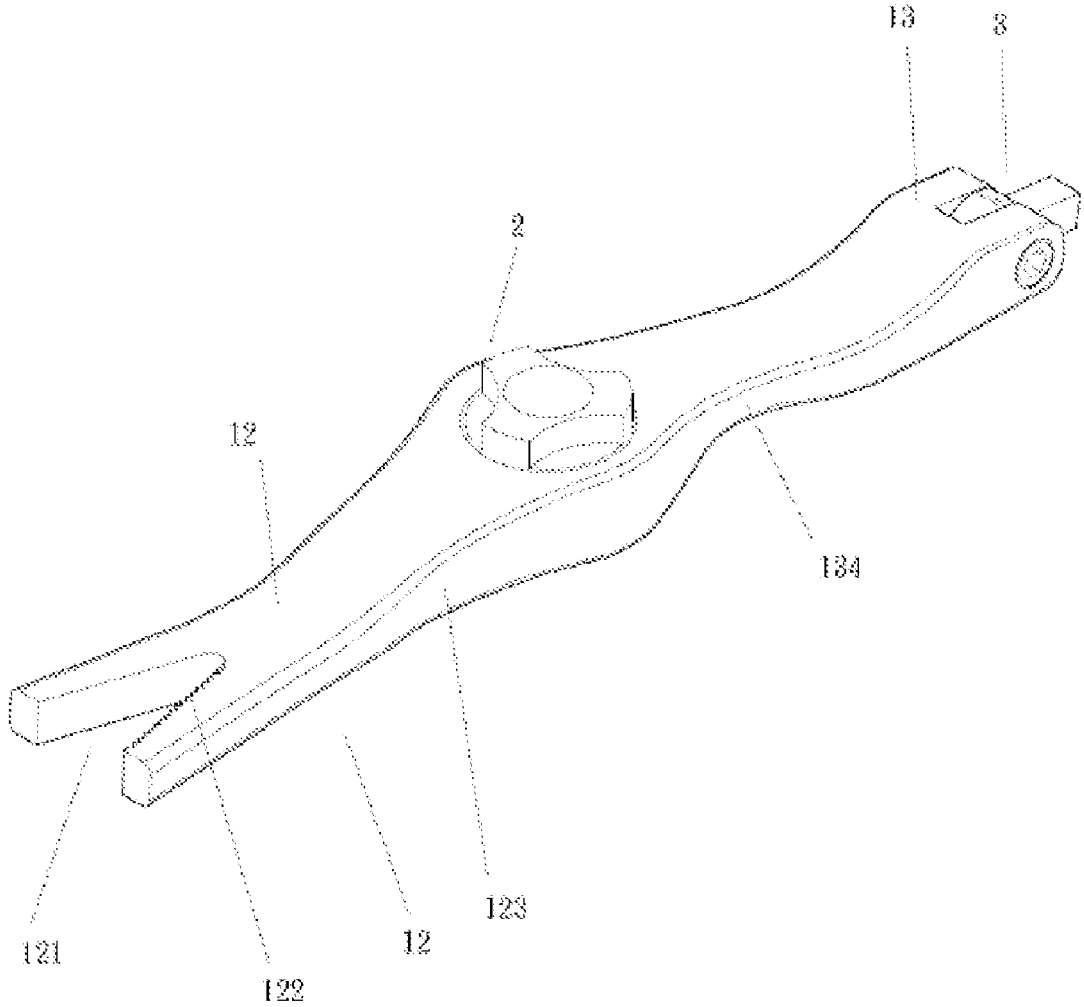
FIG. 2 is a perspective assembly view of a combination wrench in accordance with a preferred embodiment this invention.
Figure 3:
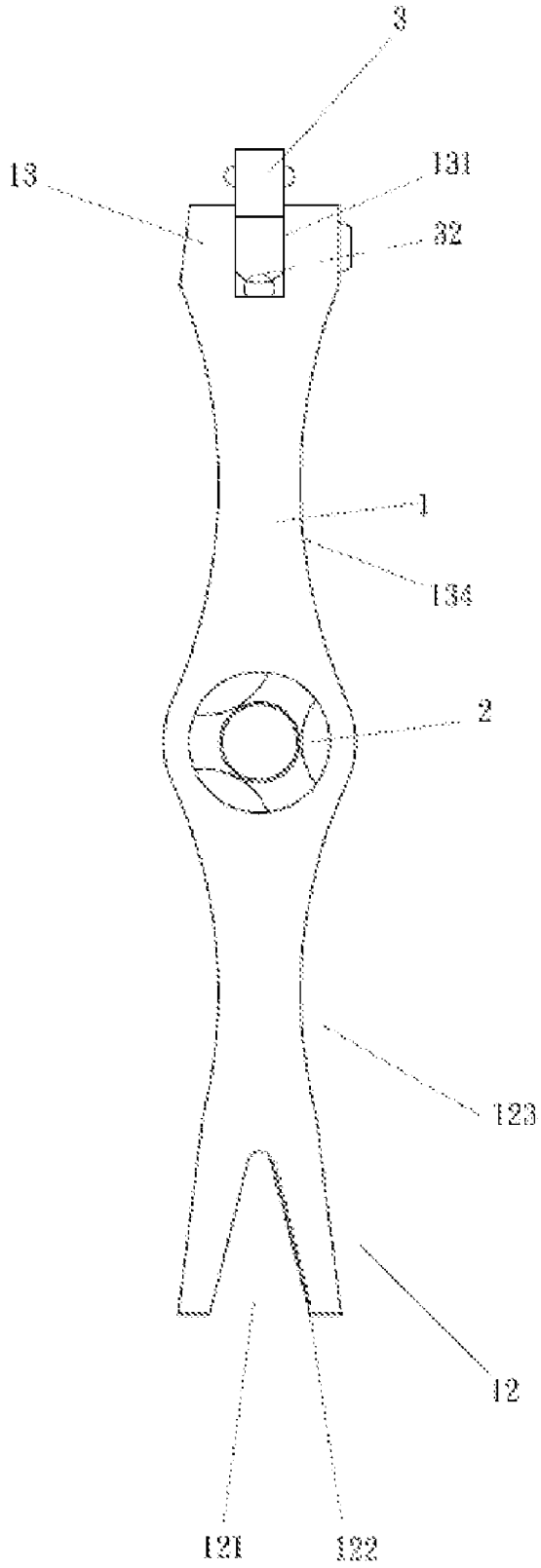
FIG. 3 is a top plan view thereof, showing a symmetrical streamlined dual-handle.

Please refer to FIGS. 1–3 for an illustration of a combination wrench in accordance with this invention. FIG. 1 is an exploded perspective view of a preferred embodiment. The wrench includes main body 1. The two handle portions from the two ends of the wrench to the center of the wrench concave inwardly in a streamlined way, resulting in a first handle section 123 and a second handle section 134, ergonomically adapted for a hand-holding gesture.

Figure 5:
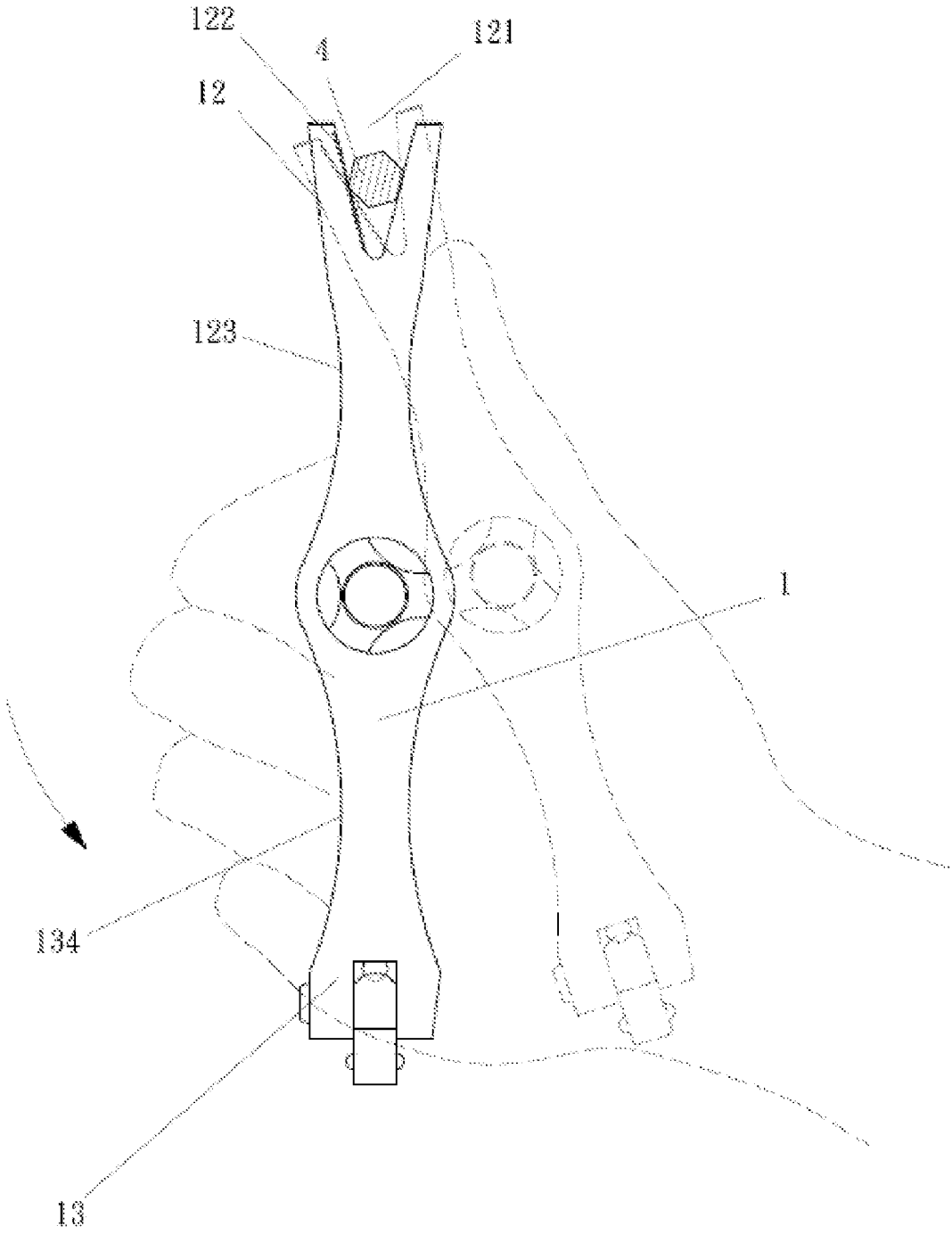
FIG. 5 is an operational view of the V-shaped socket wrench with a fastener clamped within.

The combination wrench terminates in open-end wrench 12 at a first end. The opening jaws define a substantially V-shaped socket 121 for engaging fasteners (not shown in FIG. 1) of sizes smaller than the distance between the inner sides of the tips of jaws. The inner side of a jaw contacting fasteners has teeth 122 for a firm clamping. FIG. 5 depicts the operation mode for open-end socket wrench 12 clamping bolt 4, where the thumb attaches nicely to streamlined handle section 123.

A second piece in this combination wrench, the ratchet wrench, occupies in the middle or center of the whole wrench. Ratchet driving body 2 is a unitary piece, integrally configured from bottom to top with drive shaft 22 for engaging sleeves, lower annular groove 24, outer periphery 211 with a plurality of teeth, upper annular groove 212, and direction-switch 21 on the top. Direction-switch 21 controls the direction of ratchet drive body 2 in tightening or loosening fasteners.

Figure 4:
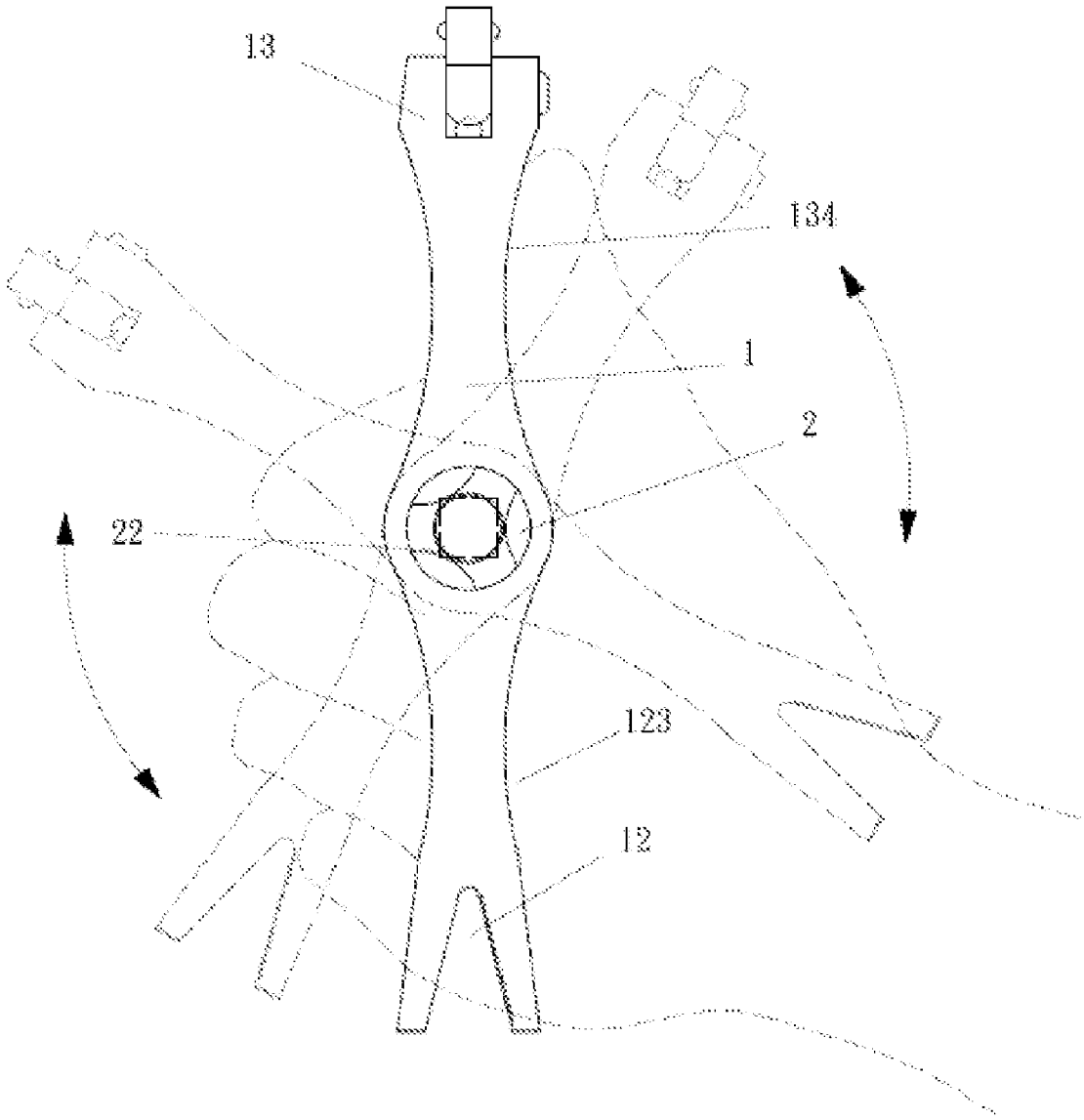
FIG. 4 is an operational view of the ratchet wrench.

Receiving chamber 11 in the center of the combination wrench defines a circular compartment with toothed inner wall 111. Right above toothed inner wall 111 stands top annular groove 112. In assembly, ratchet driving body 2 is rotatably mounted in receiving chamber 11, with toothed outer periphery 211 and toothed inner wall 111 making a thread joint; upper annular groove 212 locking with top annular groove 112; securing snap coil 23 engaging with lower annular groove 24 of ratchet driving body 2 in receiving chamber 11. FIG. 2 shows a perspective assembly view of the ratchet wretch. FIG. 4 shows the operational mode of the ratchet wrench in rotation, where the thumb fits properly into streamlined handle section 134.

A third piece of a combination wrench in accordance with this invention is an adjustable mortise-tenon pivotal wrench, positioned at the other end of the whole wrench body, as FIG. 1 shows. The two ends of mortise 13, sticking out at the end of the wrench body, defines U-shape slot 131. Mortise 13 includes screw through bore 132 on each side of the sticking-out portions for placement of pivotal screw 135.

Tenon 3 is a block resembling T-shape with a vaulted roof, coupling with mortise 13 to make an adjustable mortise-tenon wrench, as shown in FIG. 1. Tenon 3 has ball hole 32 in its vaulted roof for anchoring with a spring-ball system when making a joint with mortise 13, as described in details in the next paragraph. Tenon 3 further includes side through-hole 31 traversing its upper body for pivotal screw 135 to go through when coupling with mortise 13 in U-shape slot 131. As a result, when tenon 3 is coupled with mortise 13, side through-hole 31 communicates with screw through bore 132 in U-shape slot 131.

Please refer to FIG. 1A for the following descriptions. Spring-ball system 133 acts an interface between tenon 3 and mortise 13, or more specifically an interface between ball hole 32 in the vaulted roof of tenon 3 and the inner wall of mortise 13, which faces the vaulted roof. Spring-ball system 133 comprises a metal ball linked with a spring. The end of the spring is fixed to the inside wall of mortise 13, while the metal ball anchors in ball hole 32, facilitating in positioning and stretching flexibility of tenon 3. As a result, when tenon 3 is adjusted to best fit a fastener's position, the metal ball of spring-ball system 133 serves as a spherical buttress against which ball hole 32 anchors.

Figure 6:
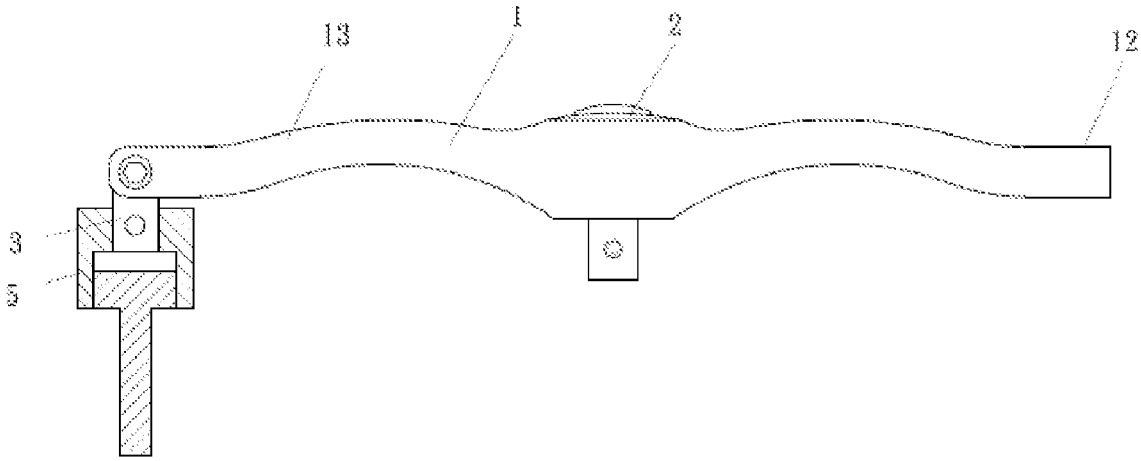
FIG. 6 is an operational view of the adjustable mortise-tenon pivotal wrench.

FIG. 6 shows that a substantially square drive shaft at the bottom of tenon 3 engaging sleeve 5. When approaching fasteners from different directions, the position of tenon 3 relative to the whole wrench body can be adjusted accordingly. In FIG. 6, tenon 3 is adjusted to be perpendicular to the wrench body.

The invention claimed is:

1. A combination wrench comprising:

(A) a ratchet wrench positioned in the middle of said combination wrench;

(B) a pair of opening jaws disposed at one end of said combination wrench, and spaced to define an opening for a workpiece; and (C) a mortise-tenon pivotal wrench at the other end of said combination wrench.

2. The wrench as claimed in claim 1 wherein said ratchet wretch comprises:

(A) a receiving chamber having a top circular groove at the top of the inner wall, wherein said inner wall has a plurality of ratchet teeth for engagement;

(B) a ratchet driving body to be received in said receiving chamber, wherein said ratchet driving body includes, from bottom to top, a drive shaft to snap onto workpieces, a lower annular groove for engagement, an outer toothed wall for meshing with said inner wall of said receiving chamber, an upper annular groove for joining with said top circular groove of said receiving chamber, and a direction-switch to control the rotation of said ratchet wrench; and (C) a securing snap coil to lock in with said lower annular groove of said ratchet driving body at the bottom of said receiving chamber.

3. The wrench as claimed in claim 2 wherein said drive shaft is substantially squarely shaped to accommodate standard sleeves.

4. The wrench as claimed in claim 1 wherein said mortise-tenon pivotal wrench comprising (A) a mortise defining a substantially U-shaped recess at one end of said combination wrench, confined by the two sticking-out portions and an inner side of said mortise, wherein said mortise includes a through-hole in said two sticking-out portions for placement of screws, (B) a tenon for coupling with said mortise in said U-shaped recess including, from bottom to top, a driving shaft at the bottom to snap onto sleeves, a side bore on both sides for communicating with said through-hole in said mortise, and a ball hole for anchoring in said inner side of said mortise, (C) a spring-ball system having a metal ball linked with a spring as a positioning and stretching interface between said mortise and said tenon, wherein the end of said spring is fixed to said inner side of said mortise, and said metal ball anchors in said tenon through said ball hole, and (D) a pivotal screw passing through said side bore of said tenon, as well as said through-hole of said mortise for a pivotal movement of said tenon.

5. The wrench as claimed in claim 4 wherein said driving shaft is substantially squarely shaped to accommodate standard sleeves.

6. The wrench as claimed in claim 1 wherein said pair of opening jaws has a substantially V-shaped profile.

7. The wrench as claimed in claim 1 wherein one of said pair of jaws is toothed on the attachment side with workpieces.

8. The wrench as claimed in claim 1 wherein the two handle sections from the two ends to the middle of said combination wrench concave inwardly in a streamlined way, adapted for a comfortable hand holding gesture.

* * * * *